United States Patent [19]

Gonzalez

[11] 4,129,020

[45] Dec. 12, 1978

[54] VEHICULAR TRUNK LOCK REPLACEMENT PLATE

[76] Inventor: Neil Gonzalez, 46-14 197th St., Flushing, N.Y. 11358

[21] Appl. No.: 831,742

[22] Filed: Sep. 9, 1977

[51] Int. Cl.[2] ..... E05B 63/00

[52] U.S. Cl. ..... 70/417; 70/431; 70/452

[58] Field of Search ..... 70/417, 452, 431, 447, 70/448, 451, 452

[56] References Cited

U.S. PATENT DOCUMENTS

| | | | |
|---|---|---|---|
| 3,768,284 | 10/1973 | Kent | 70/417 |
| 4,041,741 | 8/1977 | Cintron | 70/417 |

*Primary Examiner*—Robert L. Wolfe
*Attorney, Agent, or Firm*—Daniel Jay Tick

[57] ABSTRACT

A plate is affixable to the body of an automotive vehicle over a hole in the trunk of the vehicle for replacing the trunk lock of the vehicle. The plate has a central aperture formed therethrough and a protrusion therearound. The protrusion has a slotted hole formed through a base end thereof with a plurality of keyway slots formed therearound to accommodate a trunk lock replacement.

3 Claims, 4 Drawing Figures

VEHICULAR TRUNK LOCK REPLACEMENT PLATE

BACKGROUND OF THE INVENTION

The present invention relates to a vehicular trunk lock replacement plate.

The replacement plate of the invention replaces the damaged lock opening in the trunk of a vehicle. The replacement plate of the invention restores a car trunk to its original appearance. The plate is affixed to the body of the vehicle over the opening left by the previous lock, which was removed or broken out, so that a new replacement lock may be installed. This restores the trunk to a lockable condition. The keyway slots of the protruding center of the escutcheon plate permit the mounting of a replacement lock with facility and rapidity.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
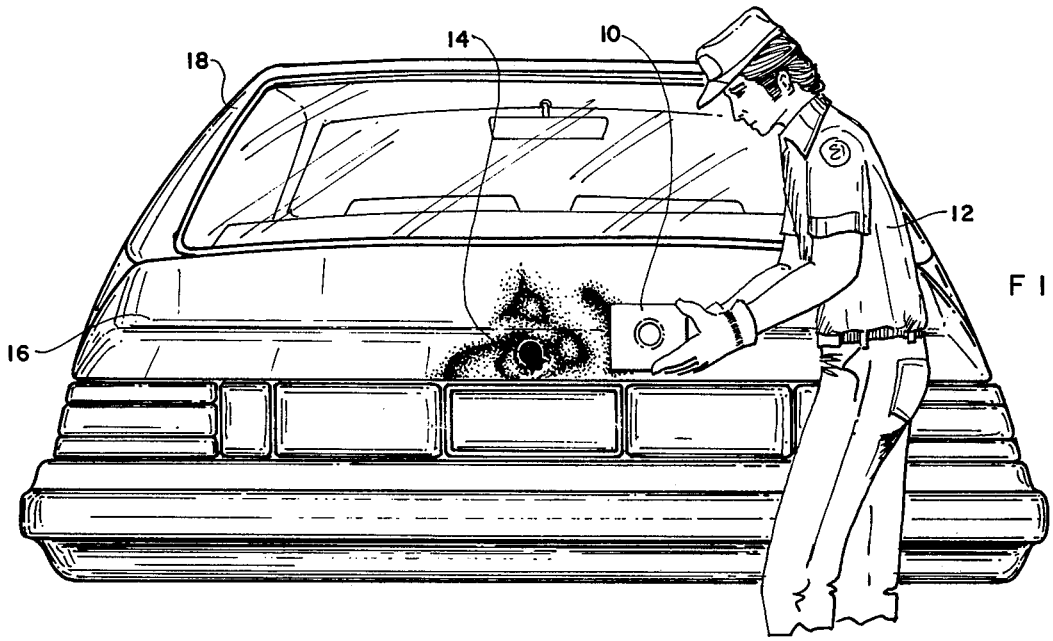
FIG. 1 is a view of an embodiment of the replacement plate of the invention in installable position.

The vehicular trunk lock replacement plate of the invention permits the replacement of the trunk lock of an automotive vehicle 18 when the original trunk lock is gone and a hole 14 through the body of the vehicle is left in its stead, as shown in FIG. 1.

The vehicular trunk lock replacement plate of the invention comprises an escutcheon plate 10 (FIGS. 1 to 4) of generally planar configuration adapted to be affixed to the body 16 of the vehicle 18 for covering the hole 14 through the body of the vehicle. The escutcheon plate has a central circular hole, shown in FIGS. 2 and 4, of predetermined diameter formed therethrough.

Figure 3:
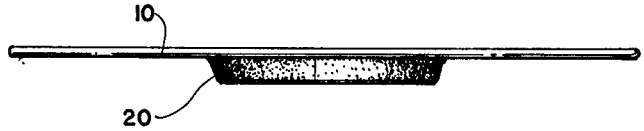
FIG. 3 is a view, taken along the lines III—III, of FIG. 2.
Figure 4:
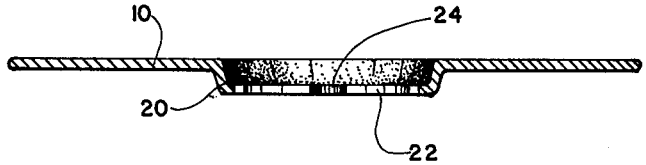
FIG. 4 is a cross-sectional view, taken along the lines IV—IV, of FIG. 2.

A substantially frustoconical protrusion 20 around the central hole is shown in FIG. 4. The frustoconical protrusion 20 has a base end spaced from the plate 10, as shown in FIGS. 3 and 4. A slotted circular hole 22 is formed through the base end coaxially with the central hole and of smaller diameter than the predetermined diameter.

Figure 2:
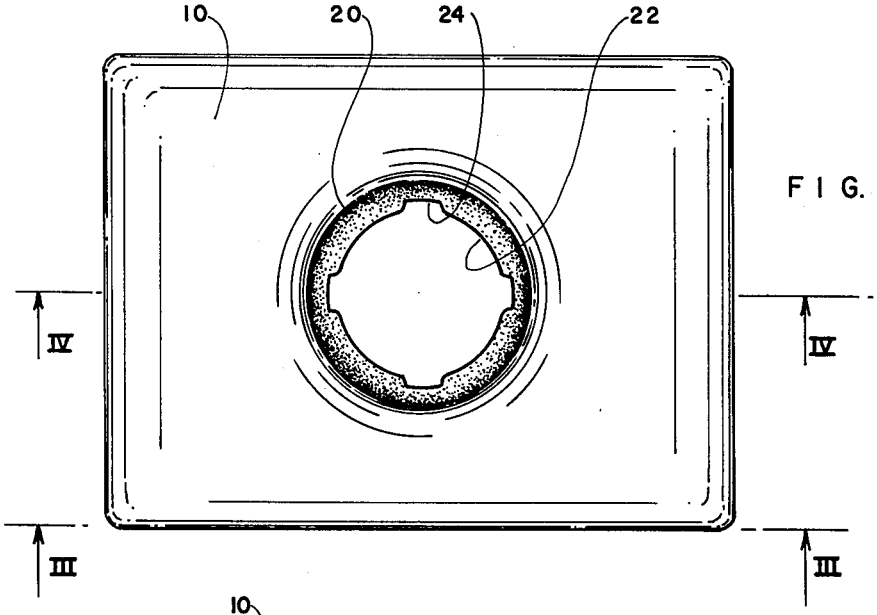
FIG. 2 is a plan view, on an enlarged scale, of the embodiment of FIG. 1.

The base end has a plurality of keyway slots 24 (FIGS. 2 and 4) formed therein around the slotted hole 22 for accommodating a trunk lock replacement. The keyway slots 24 are spaced rectangular indentations in the base end on the circumference of the slotted hole 22, as shown in FIG. 2.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. A vehicular trunk lock replacement plate for replacing the trunk lock of an automotive vehicle when the original trunk lock is gone and a hole through the body of the vehicle is left in its stead, said vehicular trunk lock replacement plate comprising an escutcheon plate of generally planar configuration adapted to be affixed to the body of the vehicle for covering the hole through the body of the vehicle, said escutcheon plate having a central circular hole of predetermined diameter formed therethrough and a substantially frustoconical protrusion around said central hole, said frustoconical protrusion having a base end spaced from said plate with a slotted circular hole formed therethrough coaxially with said central hole and of smaller diameter than the predetermined diameter, said base end having a plurality of keyway slots formed therein around said slotted hole for accommodating a trunk lock replacement.

2. A vehicular trunk lock replacement plate as claimed in claim 1, wherein said keyway slots are spaced indentations in said base end on the circumference of said slotted hole.

3. A vehicular trunk lock replacement plate as claimed in claim 2, wherein each of said indentations is of rectangular configuration.

* * * * *